United States Patent [19]

Guillemot

[11] 4,309,695

[45] Jan. 5, 1982

[54] ELECTRONIC ALARM CIRCUIT

[76] Inventor: Gilbert Guillemot, 7 Libération St., 95650 Courcelles on Viosne, France

[21] Appl. No.: 104,856

[22] Filed: Dec. 18, 1979

[30] Foreign Application Priority Data

Dec. 27, 1978 [FR] France ..... 78 36419

[51] Int. Cl.[3] ..... G08B 29/00

[52] U.S. Cl. ..... 340/514; 340/501

[58] Field of Search ..... 340/514, 515, 568, 571, 340/500, 501

[56] References Cited

U.S. PATENT DOCUMENTS 3,392,379 7/1968 Thomason et al. ..... 340/514

3,955,183 5/1976 McBrian ..... 340/514

*Primary Examiner*—Alvin H. Waring

*Attorney, Agent, or Firm*—Gerald J. Ferguson, Jr.; Joseph J. Baker

[57] ABSTRACT

An electronic alarm circuit for operating an audible alarm, such as a bell, has a trigger circuit arranged to continuously activate the alarm if a sensor is activated. The circuit also includes a capacitor arranged to be discharged if a normally closed test switch is opened. Closure of the test switch recharges the capacitor and renders the trigger circuit conductive. The alarm is thus activated but only for a restricted period dependent upon the time constant of the capacitor. Accordingly, it is possible to distinguish between a real alarm and the sound of the alarm when the circuit is tested.

9 Claims, 4 Drawing Figures

ELECTRONIC ALARM CIRCUIT

BACKGROUND OF THE PRESENT INVENTION

The present invention relates to an electronic alarm circuit for operating an audible alarm such as an electromechanical buzzer or a bell. This electronic alarm circuit provides discrimination between the sound of the alarm on test and the sound indicating a real alarm.

Known alarm circuits include a buzzer which is triggered by means of the closure of a remote, normally open switch. Such a circuit has the following disadvantages:

in order to check that the buzzer and the line connecting the switch to the buzzer are working it is necessary to short-circuit the terminals of the switch. However, the switch is often remote from the test centre where the buzzer is located and may even be inaccessible;

the test produces an audible signal which can be interpreted as a real alarm;

bad contacts producing transient faults may exist in the circuit, but may not be detected by the test.

The alarm circuit of the invention seeks to minimize these disadvantages.

SUMMARY OF THE PRESENT INVENTION

According to the present invention there is provided an electronic alarm circuit comprising operating means for operating an alarm, a sensor circuit comprising at least one sensor, and a trigger circuit for activating said operating means, wherein said trigger circuit is arranged to continuously activate said operating means when said sensor is activated, and said trigger circuit is arranged to activate said operating means for a restricted period if a transient fault arises in the alarm circuit.

It will be appreciated that the audible alarm is operated in its normal manner when signalling a real alarm, and operates in a different manner when transient faults arise. In addition, a normally closed test switch may be connected in series with the sensor circuit, such that opening and closing this switch activates the alarm for the restricted period. This test switch is preferably located close to the audible alarm.

In an embodiment, the alarm circuit comprises a semiconductor trigger circuit the output of which is connected in series with the normally-closed contact of an electro-mechanical bell of conventional type, and the input of which receives the control signal. The circuit is arranged to present at its output a conducting state as soon as it receives a control pulse at the input, and to maintain this state until the output current is cut, and the cycle can only repeat itself if the input signal is present; such a circuit can be implemented with a thyristor or two transistors or any combination of these elements. The alarm circuit combines this trigger circuit with a capacitor and a shunt resistor, both of which are connected in parallel at the trigger circuit input in such a manner that the charging current of the capacitor constitutes the control pulse. This energizes an electromagnet controlling the normally-closed contact and lasts until the normally-closed contact cuts the current so that a movable armature of the electromagnet performs only one cycle and produces one audible ring. If a switch is closed in parallel with the capacitor, the conducting state of the trigger circuit can be maintained continuously and the bell rings in its normal manner to signal a real alarm.

BRIEF DESCRIPTION OF THE DRAWINGS

An embodiment of the present invention will hereinafter be described, by way of example, with reference to the accompanying drawings, in which.

DESCRIPTION OF THE PREFERRED EMBODIMENTS

Figure 1:
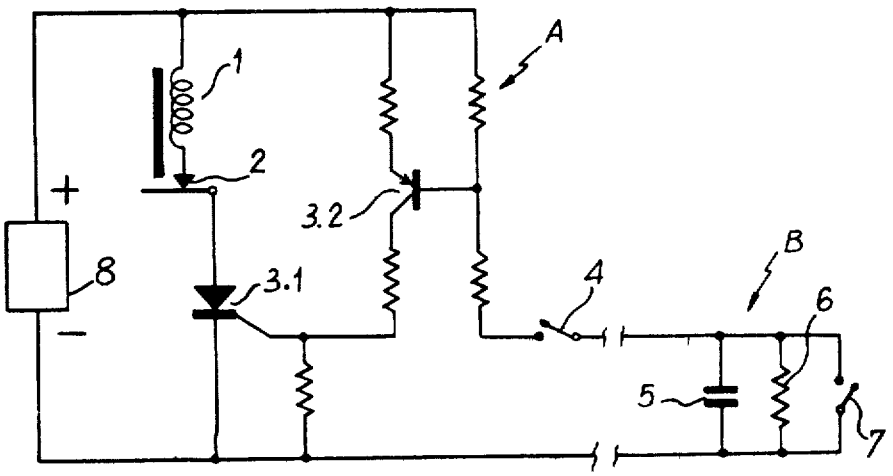
FIG. 1 is a circuit diagram of an electronic alarm circuit including an operational test circuit.

The alarm circuit illustrated in FIG. 1 includes a device A comprising an electromagnet 1 and a normally-closed contact 2 which are mechanically coupled to a bell, buzzer or other audible alarm (not shown). For example, the electromagnet 1 may be arranged to operate the hammer of a bell. The normally-closed contact 2 is connected in series with a thyristor 3.1, the gate of the thyristor 3.1 being connected to a transistor 3.2. The two elements 3.1 and 3.2 form an electronic triggering circuit and are biased in conventional manner by means of appropriate resistors. A switch 4 is connected in series between the electronic triggering circuit, more simply called the trigger, and a sensor circuit B. The sensor circuit B consists of a capacitor 5, a resistor 6 and at least one normally-open switch 7. The sensor circuit B is arranged to sense an event which should trigger the alarm in consequence of the switch 7 closing.

The alarm circuit is connected to a direct-current source 8. In the monitoring condition the switch 4 is closed and the thyristor 3.1 and the transistor 3.2 are non-conducting.

When the switch 4 is opened the capacitor 5 is discharged through the resistor 6. If the switch 4 is then closed the capacitor 5 is charged and the transistor 3.2 and the thyristor 3.1 conduct. The electromagnet 1 is energized and attracts the movable armature of the normally-closed contact 2 such that the alarm bell is rung. The capacitance of the capacitor 5 is selected such that charging is terminated and the transistor 3.2 is again cut off when the thyristor 3.1, after the break caused by the movement of the armature of the normally-closed contact 2, is again placed under voltage by the return movement of the armature. Thus, the ringing of the bell then stops even though the switch 4 remains closed.

A short break followed by a contact closure in one of the two supply lines of the source 8 triggers the same cycle due to the fact that the capacitor 5 discharges through the resistor 6 and the capacitor is then recharged.

Similarly, a short break in the line at any point followed by a closure, triggers the same cycle in the same manner.

In contrast thereto, if the switch 7 is closed the transistor 3.2 and the thyristor 3.1 conduct continuously and the bell sounds in the alarm mode.

In a further embodiment of the alarm circuit (not shown), an inverting transistor is interposed between the switch 7 and the rest of the circuit. In this case the switch 7 is normally closed and the alarm circuit remains at rest when the switch 7 is closed and the alarm bell is rung when the switch is opened.

The alarm circuit described may be used in any monitoring system where it is required to differentiate between the main monitoring signal and the signals connected with testing the monitoring device. It is of particular interest for mobile installations in which bad contacts or circuit interruptions are always a danger.

Figure 2:
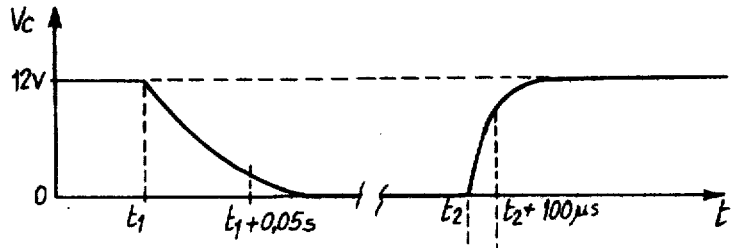
FIGS. 2 to 4 are graphs showing voltage and current as a function of time during operation of the circuit of FIG. 1.
Figure 3:
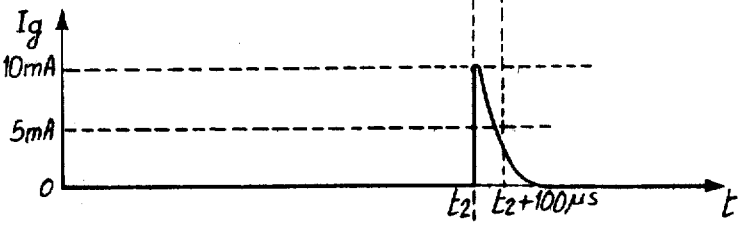
Figure 4:
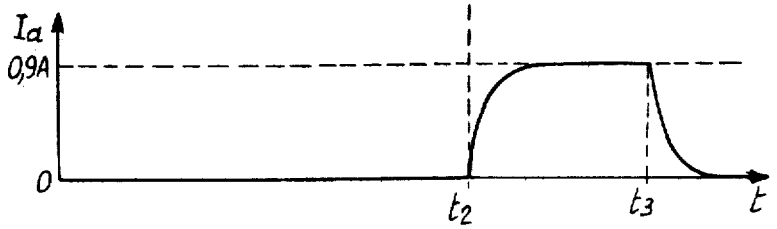

As a particular example, FIGS. 2 to 4 illustrate a preferred embodiment according to FIG. 1 wherein the components have the following characteristics:

Resistance of electro-magnet 1: 13.5 Ohms;

Voltage of power source 8: 12 Volt;

Thyristor 3.1:

minimum control current 5 mA, minimum closed circuit current 5 mA, minimum duration of control current 2 microseconds.

The transistor 3.2 is connected in circuit such that it has:

an output resistance of 1200 Ohms, and an input resistance of 2000 Ohms.

The capacitor 5 has a capacitance of 50 nanofarads.

The shunt resistor 6 has a resistance of 1 Megohm.

This circuit operates in the following manner.

If the line is cut (on one or the other of the conductors) at instant $t_1$ between the device A, and the sensor circuit B the capacitor 5 loses the major part of its charge by the end of a time of 0.05 seconds (discharge time constant). If the line is then restored at instant $t_2$, the capacitor is recharged in the very short time of 100 microseconds (charge time constant). The two phenomena are shown in FIG. 2.

While the capacitor 5 is charging, the transistor 3.2 is conducting and its collector circuit supplies a current pulse, shown in FIG. 3, to the gate of the thyristor 3.1 and thus triggers the thyristor 3.1 into conduction within a few microseconds (well before the end of the charging of the capacitor and the end of conduction of the transistor 3.2).

The direct anode/cathode current of the thyristor 3.1, shown in FIG. 4, is thus established at instant $t_2$ and attains a maximum value of 0.9 Amperes, having exceeded its closed-circuit current of 5 mA before the current to the gate has ceased. Thus, the thyristor 3.1 can only be switched off by interrupting its anode current. Such an interruption is produced when the movable armature opens the normally-closed contact 2, at instant $t_3$ in FIG. 4, approximately 5 milliseconds after instant $t_2$.

The combined effects of the inertia of the movable armature and of the return force of a spring biasing the armature drive the hammer to strike audibly on the bell, and the armature to return back, accompanied by the closure of the normally-closed contact 2 whereupon the direct voltage is applied again to the thyristor. However, as there is now no current on the gate of the thyristor it can no longer conduct.

It can thus be seen that the bell, which normally vibrates at a frequency of about 100 Hertz, has only a period of 0.01 seconds for delivering a single audible ring and is then immobilized.

The switch 4, which is located close to the device A or is incorporated therein, is a manual device which allows the operator to trigger the phenomenon described above, and in this manner to simultaneously test, by virtue of the audible ring obtained:

(a) that the monitoring device is operating properly, (b) that there are no cuts along the lines linking the device A to the sensor circuit B, on the one hand, and to the source 8, on the other hand, and (c) that the RC section 6,5, mounted close to the switch 7, is functioning properly.

If the normally-closed switch 4 has not been activated, random bad contacts or breakages, which occur either in the input circuit of the device A, or on the line linking the device A to the sensor circuit B, or on the line linking the device A to the source 8, trigger off audible rings every time that they occur, due to the discharging and recharging of the capacitor 5.

Finally, it is clear that the closure of the switch 7, caused by the occurrence of the phenomenon monitored switches the transistor 3.2 and the thyristor 3.1 into constant conduction and that the bell then vibrates in its normal rhythm.

It will be appreciated that the switch 7 is here used to represent, for the sake of convenience, all equivalent means which are capable of presenting, in the monitoring condition, an internal resistance which is high enough, and which becomes low enough, when the monitored event occurs, to activate the trigger and the real alarm.

Also, the sensor circuit can be deprived of the resistor 6 and the capacitor 5 provided it presents between its terminals, in the monitoring condition, an impedance with the desired capacitive and resistive components, the resistance becoming low enough to trigger the alarm at the required moment.

Of course, a commutator with a coded sequence can replace the switch 4 and produce, in the monitoring condition, a stepped sequence of isolated rings of the bell, which is equivalent to a constant test of the proper operation of the alarm circuit.

A means, known in itself, of a semiconductor inverter type can replace the switch 7 so that the alarm is triggered with an opening rather than with a closing of the switch.

I claim:

1. An electric alarm circuit comprising an alarm indicating section with an electromagnet having a movable armature and a normally closed contact, movement of the armature being arranged to operate an alarm, a sensor circuit comprising at least one switch alarm means, a capacitor and a resistor, and a trigger circuit causing the electromagnet to move the armature when the capacitor is charging, and connected in series with the normally closed contact, said capacitor being connected at the input of the trigger circuit through a normally closed test switch means located close said alarm indicating section, such that charging of the capacitor causes the trigger circuit to briefly conduct and energize the electromagnet thereby moving the armature, the movement of the armature causing the trigger circuit to become non conductive when said test switch means has been activated, whereby a single opening and closing movement of the armature is produced when said switch alarm means is not activated.

2. A circuit according to claim 1, wherein the capacitor and the resistor are connected in parallel at the input of the trigger circuit, the resistor having a sufficiently large resistance such that the trigger circuit is not activated, the capacitor being charged by the supply of the trigger circuit and discharging through the resistor when voltage is no longer applied thereto and becoming recharged when voltage is again applied thereto and rendering the trigger circuit conductive.

3. A circuit according to claim 1, further comprising two conductors connecting the sensor circuit to the input of the trigger circuit, said normally-closed test switch means being connected in one of said two conductors, whereby sequentially opening and closing said normally-closed test switch means discharges and then recharges the capacitor whereby the alarm is activated for a brief period only.

4. A circuit according to claim 3, further comprising a bifilar line connecting the capacitor/resistor assembly to the rest of the alarm circuit.

5. A circuit according to claim 4, wherein said switch alarm means comprises a bipolar device having an internal resistance which is low enough to activate the trigger circuit when the switch means is activated.

6. A circuit according to claim 4, wherein said switch alarm means is arranged to have, in its unactivated condition, an impedance the resistive and capacitive components of which have such values that it is possible to omit the parallel resistor and/or capacitor, the resistive component being low enough to control the trigger circuit if the switch alarm means is activated.

7. A circuit according to claim 3, wherein said normally-closed test switch means is a commutator with a coded sequence arranged to successively activate said alarm for brief periods.

8. A circuit according to claim 4, wherein said switch alarm means connected in parallel with the capacitor and the resistor comprises a semiconductor circuit of the inverting type controlled by a normally closed switch.

9. A circuit according to claim 8, wherein the semiconductor circuit is arranged such that its internal resistance assumes a value which is high enough to ensure that the trigger circuit conducts when the normally closed switch is opened.

* * * * *